United States Patent [19]

Wadleigh

[11] Patent Number: 4,649,959

[45] Date of Patent: Mar. 17, 1987

[54] ANTIBURST SYSTEM FOR WATER LINES

[76] Inventor: Edward R. Wadleigh, P.O. Box 1709, Hemet, Calif. 92343

[21] Appl. No.: 786,471

[22] Filed: Oct. 11, 1985

[51] Int. Cl.[4] ..... E03B 7/10

[52] U.S. Cl. ..... 138/28; 137/59; 137/301; 237/80

[58] Field of Search ..... 138/28, 27, 32; 123/41.5; 137/59, 301; 237/80

[56] References Cited

U.S. PATENT DOCUMENTS

| | | | |
|---|---|---|---|
| 596,062 | 12/1897 | Firey | 138/28 |
| 742,511 | 10/1903 | Stebbins | 138/27 |
| 1,927,105 | 9/1933 | Welch | 138/27 |
| 2,360,596 | 10/1944 | Tickel | 138/28 |
| 2,409,304 | 10/1946 | Morrison | 138/28 |
| 2,599,325 | 6/1952 | Fritzberg | 138/28 |
| 2,629,402 | 2/1953 | Cook | 138/28 |
| 2,688,976 | 9/1954 | Baker | 137/301 |
| 3,208,438 | 9/1965 | White | 138/28 |
| 4,321,908 | 3/1982 | Reed | 237/80 |

FOREIGN PATENT DOCUMENTS

| | | | |
|---|---|---|---|
| 876988 | 11/1942 | France | 138/32 |
| 2478161 | 9/1981 | France | 138/32 |
| 73318 | 3/1948 | Norway | 137/59 |
| 90522 | 10/1937 | Sweden | 138/30 |
| 10030 | of 1898 | United Kingdom | 137/301 |

*Primary Examiner*—Stephen Marcus
*Assistant Examiner*—Leo J. Peters
*Attorney, Agent, or Firm*—Harvey S. Hertz

[57] ABSTRACT

An antiburst system for water lines. A pipe has an inlet connected to a source of water and an outlet. A flexible tube is positioned in the pipe and is supported by a coiled spring extending along the longitudinal axis of the tube. An air vent section is coupled to the interior of the flexible tube for enabling atmospheric air to enter and escape from the interior of the flexible tube.

4 Claims, 4 Drawing Figures

ANTIBURST SYSTEM FOR WATER LINES

BACKGROUND OF THE INVENTION (1) Field of the Invention

The invention relates in general to antiburst systems for use in water lines, and more particularly, to a pipe section for insertion along a water line for absorbing contraction and expansion when freezing of a water line occurs.

(2) Description of the Prior Art

A major problem in water lines, which are used primarily exterior of a building, is the bursting of the water line when the water therein freezes and expands. Typically, a compressable material is placed inside or adjacent the pipe to prevent the pipe from splitting when the fluid therein expands upon freezing. The material, typically rubber, loses its compressability after a while and no longer functions in the desired manner. Other problems in these devices are that air does not remain entrapped within the sealed rubber tube, but rather seeps away in time, with the result that the tube remains flattened during normal operating temperatures and does not provide the emergency volume needed during freezing. Additionally, when using rubber, it has been found that compression occurs along the diameter of the rubber, while expansion will subsequently occur longitudinally, causing a rupture at a different location in a pipe.

Where it is desired to prevent loss of air in the pipe containing the compressable material, complicated arrangements, such as utilizing an air pump, have been proposed. See, for example, U.S. Pat. No. 3,989,032.

Other known patents include U.S. Pat. Nos. 596,062; 926,092; 2,599,325; 2,629,402; 4,227,512; and 4,308,856.

SUMMARY OF THE INVENTION

The present invention provides an antiburst system for use in water lines. A pipe which is connected to a source of water has an outlet. A flexible tube is positioned in the pipe and is supported by a coil spring extending along the longitudinal axis of the tube. An air vent section is coupled to the interior of the flexible tube for enabling atmospheric air to enter and escape from the interior of the flexible tube.

DESCRIPTION OF THE PREFERRED EMBODIMENTS

Figure 1:
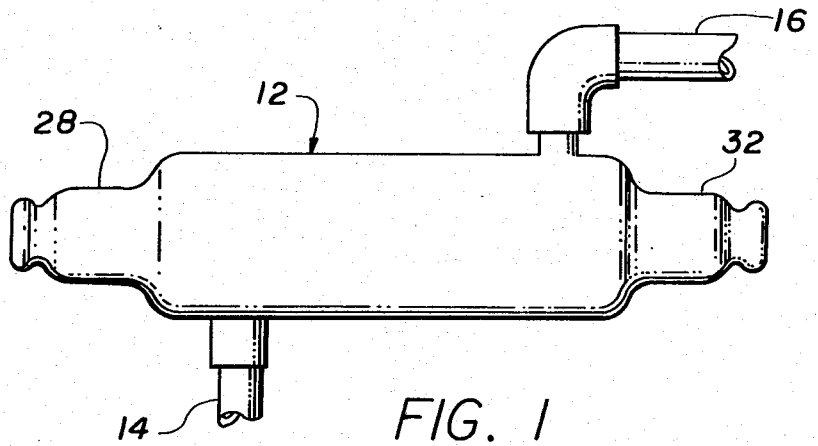
FIG. 1 is a perspective view of an antiburst tube illustrated connected to a water line.

Referring now to the drawings, there is shown in FIG. 1 an antiburst tube 12 constructed in accordance with principals of the invention. The antiburst tube is normally connected between a water main 14 or other source of water and a water outlet 16. Typically, the water outlet could be a sprinkler system, a solar panel or other fluid source. In addition, it should be understood that the antiburst tube could be used in closed loop systems where fluid is continuously circulated, such as in a solar heating panel which is periodically subject to freezing temperatures.

Figure 2:
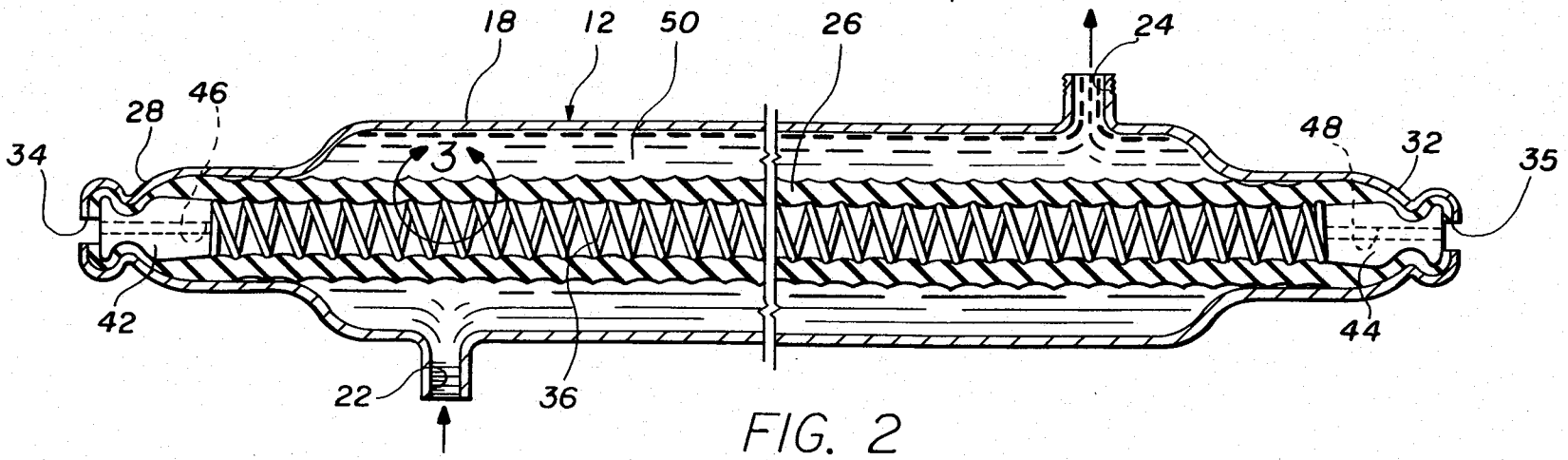
FIG. 2 is a cross-sectional view of the antiburst tube of FIG. 1.

Referring now to FIG. 2, the antiburst tube 12 of FIG. 1 is shown in greater detail in cross-sectional view and comprises an elongated rigid pipe 18 which is normally connected to the water main 14 and water outlet 16 (FIG. 1) by means of a threaded connection at its respective inlet and outlet ports 22 and 24.

A flexible tube 26 is positioned within the rigid pipe 18 and spaced from the walls thereof along the central portion of the pipe 18. Typically, water which enters the inlet port 22 will flow around the outer surface of the flexible tube 26 and exit the rigid pipe 18 via the outlet port 24. The ends 28 and 32 of the rigid pipe 18 are tapered so that the interior surfaces thereof are juxtaposed with the exterior surface of the flexible tube 26, with openings 34 and 36, respectively, formed in the ends of the rigid pipe. Simultaneously, a water seal is formed at the pipe ends 28 and 32.

A coiled spring 36 is positioned within the flexible tube 26 and is used to support the flexible tube. The coiled spring extends between a pair of termination plugs 42 and 44 which are fitted within the fexible tube 26 adjacent the pipe ends 28 and 32, respectively. These termination plugs 42 and 44 aid in the formation of a tight water seal at the pipe ends 28 and 32. Each of the termination plugs 42 and 44 have a longitudinally extending aperature 46 and 48, respectively, enabling air from the atmostphere to enter and leave the interior of the flexible tube 26.

Figure 3A:
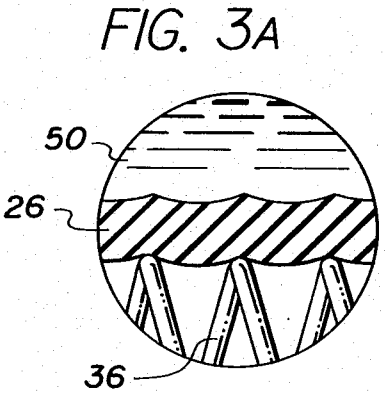
FIGS. 3*a* and 3*b* are partial sectional views of the antiburst tube of FIG. 2 used to illustrate the operation thereof.
Figure 3B:
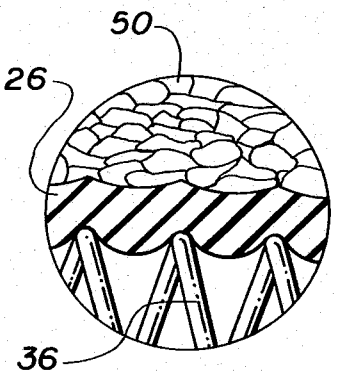

FIGS. 2, 3*a* and 3*b* illustrate the normal operation of the antiburst tube 12 when water flows from the inlet end 22 to the outlet end 24. When the liquid 46, typically water, freezes and turns to ice and expands as shown in FIG. 3*b*, deflection of the flexible tube 26 inwardly between the area of the coiled spring and prevents the rigid pipe 18 from cracking by minimizing the force applied to the interior surface of the pipe 18. In addition, the increased air pressure in the interior of the flexible tubing 26 can be released through the vent openings formed by aperatures 46 and 48.

Thus, as can be readily seen, as line pressure increases or decreases within the flexible tube 26, atmospheric pressure can freely circulate therein. Thus, when liquid 50 once again commences to flow, reducing pressure on the exterior surface of the flexible tube 26, pressure again is also reduced in the interior of the flexible tube.

With the present invention the size and diameter of the flexible tube 26 is automatically maintained by the coil spring 38 and any amount of expansion will be accepted by deflection of the flexible tube 26 inwardly. Typically, the flexible tube 26 can be of silicone rubber. However, other flexible materials could be used to suit the chemical or liquid utilized as a fluid 50.

The coiled spring 36 typically would be made of stainless steel. However, plastic or other material, if suitable for the temperature and materials being used could also be utilized.

The rigid pipe 18 is typically made of copper, steel, brass or any metal. Even rigid plastic or glass could be used under certain circumstances. It should be noted that plastic will accept expansion due to freezing, but not over long term, because each time the water expands within the interior of the member stretching occurs so that after numerous freezings, the plastic will burst.

The present invention could be used in numerous applications such as solar collectors to prevent damage due to freezing. The arrangement could also be used to protect connecting piping for both solar collectors and other plumbing appliances where piping may be subject to freezing.

In addition, in areas around the world where it is customary to wrap pipes with an electrically heated tape to maintain the temperature of the fluid within a pipe above the freezing temperature, it has been found that from time to time that power outages occur simultaneously with freezing temperatures. When this occurs, the present invention could be used as a back up system to prevent or minimize damage.

We claim:

1. An antiburst system for water lines comprising:

an elongated pipe having a fluid inlet and a fluid outlet connection:

a flexible tube, having a inner and outer surface positioned in said elongated pipe, said flexible tube surrounding and being generally coaxial with a coiled spring, said coiled spring outer surface of edges generally abutting the flexible tube inner surface;

a fluid path generally defined by the area between the inner surface of said elongated pipe and the outer surface of said flexible tube, wherein should said fluid expand in said fluid path, the flexible tubing is deflected inwardly in the spacing between said spring coils for preventing bursting of said elongated pipe.

2. An antiburst system in accordance with claim 1 wherein said pipe is made of rigid material.

3. An antiburst system in accordance with claim 1 wherein an air vent section is coupled to the interior of said flexible tube for enabling atmospheric air to enter and escape from the interior of said flexible tube.

4. An antiburst system in accordance with claim 3 wherein said pipe and the outer surface of said flexible tube form a liquid tight seal therebetween.

* * * * *